US010428436B2

(12) United States Patent
Qin et al.

(10) Patent No.: US 10,428,436 B2
(45) Date of Patent: Oct. 1, 2019

(54) INDIUM ELECTROPLATING COMPOSITIONS CONTAINING AMINE COMPOUNDS AND METHODS OF ELECTROPLATING INDIUM

(71) Applicant: Rohm and Haas Electronic Materials LLC, Marlborough, MA (US)

(72) Inventors: Yi Qin, Westborough, MA (US); Kristen Flajslik, Hopkinton, MA (US); Mark Lefebvre, Hudson, NH (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 120 days.

(21) Appl. No.: 15/594,019

(22) Filed: May 12, 2017

(65) Prior Publication Data

US 2018/0016691 A1 Jan. 18, 2018

Related U.S. Application Data

(60) Provisional application No. 62/363,550, filed on Jul. 18, 2016.

(51) Int. Cl.

| | |
|---|---|
| ***C25D 3/00*** | (2006.01) |
| ***C25D 3/02*** | (2006.01) |
| ***C25D 3/54*** | (2006.01) |
| ***C25D 5/12*** | (2006.01) |
| ***C25D 7/12*** | (2006.01) |

(52) U.S. Cl.

CPC ..... *C25D 3/54* (2013.01); *C25D 5/12* (2013.01); *C25D 7/123* (2013.01)

(58) Field of Classification Search

CPC ..... C25D 3/02; C25D 3/56
USPC ..... 205/238, 261
See application file for complete search history.

(56) References Cited

U.S. PATENT DOCUMENTS

| | | | | |
|---|---|---|---|---|
| 6,506,314 | B1 * | 1/2003 | Whitney, Jr. | C23C 28/00 216/100 |
| 7,023,089 | B1 * | 4/2006 | Lu | H01L 23/3735 257/705 |
| 8,012,334 | B2 | 9/2011 | Reddington et al. | |
| 8,048,284 | B2 | 11/2011 | Reddington et al. | |
| 8,888,984 | B2 | 11/2014 | Lee et al. | |
| 2013/0224515 | A1 * | 8/2013 | Foyet | C25D 7/005 428/673 |
| 2013/0256145 | A1 * | 10/2013 | Romer | C25D 3/60 205/253 |

(Continued)

FOREIGN PATENT DOCUMENTS

WO 2017129583 A1 8/2017

OTHER PUBLICATIONS

Search report for corresponding Europe Application No. 17 18 1755 dated Nov. 17, 2017.

(Continued)

*Primary Examiner* — Edna Wong
(74) *Attorney, Agent, or Firm* — John J. Piskorski

(57) ABSTRACT

Indium electroplating compositions containing amine compounds in trace amounts to electroplate substantially defect-free uniform indium which has a smooth surface morphology. The indium electroplating compositions can be used to electroplate indium metal on metal layers of various substrates such as semiconductor wafers and as thermal interface materials.

4 Claims, 3 Drawing Sheets

(56) References Cited

U.S. PATENT DOCUMENTS

| | | | | |
|---|---|---|---|---|
| 2015/0122662 | A1* | 5/2015 | Woertink | C25D 7/123<br>205/253 |
| 2018/0298511 | A1* | 10/2018 | Vazhenin | C25D 5/10 |

OTHER PUBLICATIONS

Search report for corresponding China Application No. 201710511262.8 dated Oct. 12, 2018.

* cited by examiner

INDIUM ELECTROPLATING COMPOSITIONS CONTAINING AMINE COMPOUNDS AND METHODS OF ELECTROPLATING INDIUM

FIELD OF THE INVENTION

The present invention is directed to indium electroplating compositions containing amine compounds in trace amounts and methods for electroplating indium metal on metal layers. More specifically, the present invention is directed to indium electroplating compositions containing amine compounds in trace amounts and methods of electroplating indium metal on metal layers where the indium metal deposit is uniform, substantially void-free and has a smooth surface morphology.

BACKGROUND OF THE INVENTION

The ability to reproducibly plate void-free uniform indium of target thickness and smooth surface morphology on metal layers is challenging. Indium reduction occurs at potentials more negative than that of proton reduction, and significant hydrogen bubbling at the cathode causes increased surface roughness. Indium ($1^+$) ions, stabilized due to the inert pair effect, formed in the process of indium deposition catalyze proton reduction and participate in disproportionation reactions to regenerate Indium ($3^+$) ions. In the absence of a complexing agent, indium ions begin to precipitate from solutions above pH>3. Plating indium on metals such as nickel, tin, copper and gold is challenging because these metals are good catalysts for proton reduction and are more noble than indium, thus they can cause corrosion of indium in a galvanic interaction. Indium may also form undesired intermetallic compounds with these metals. Finally, indium chemistry and electrochemistry have not been well studied, thus interactions with compounds that may serve as additives are unknown.

In general, conventional indium electroplating baths have not been able to electroplate an indium deposit which is compatible with multiple under bump metals (UBM) such as nickel, copper, gold and tin. More importantly, conventional indium electroplating baths have not been able to electroplate indium with high coplanarity and high surface planarity on substrates which include nickel. Indium, however, is a highly desirable metal in numerous industries because of its unique physical properties. For example, it is sufficiently soft such that it readily deforms and fills in microstructures between two mating parts, has a low melting temperature (156° C.) and a high thermal conductivity (~82 W/m° K), good electrical conductivity, good ability to alloy and form intermetallic compounds with other metals in a stack. It may be used as low temperature solder bump material, a desired process for 3D stack assembly to reduce damage on assembled chips by the thermal stress induced during reflow processing. Such properties enable indium for various uses in the electronics and related industries including in semiconductors and polycrystalline thin film solar cells.

Indium can also be used as thermal interface materials (TIMs). TIMs are critical to protect electronic devices such as integrated circuits (IC) and active semiconductor devices, for example, microprocessors, from exceeding their operational temperature limit. They enable bonding of the heat generating device (e.g. a silicon semiconductor) to a heat sink or a heat spreader (e.g. copper and aluminum components) without creating an excessive thermal barrier. The TIM may also be used in assembly of other components of the heat sink or the heat spreader stack that composes the overall thermal impedance path.

Several classes of materials are being used as TIMs, for example, thermal greases, thermal gels, adhesives, elastomers, thermal pads, and phase change materials. Although the foregoing TIMs have been adequate for many semiconductor devices, the increased performance of semiconductor devices has rendered such TIMs inadequate. Thermal conductivity of many current TIMs does not exceed 5 W/m° K and many are less than 1 W/m° K. However. TIMs that form thermal interfaces with effective thermal conductivities exceeding 15 W/m° K are presently needed.

Accordingly, indium is a highly desirable metal for electronic devices, and there is a need for an improved indium composition for electroplating indium metal, in particular, indium metal layers on metal substrates.

SUMMARY OF THE INVENTION

Compositions include one or more sources of indium ions, citric acid, salts thereof or mixtures thereof and one or more amine compounds in amounts of 0.1 ppm to 100 ppm having a formula:

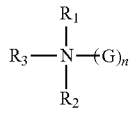

(I)

where $R_1$ is chosen from hydrogen; $(CH_2)_aNR_4R_5$ where $R_4$ and $R_5$ are independently chosen from hydrogen and linear or branched $(C_1\text{-}C_4)$alkyl and a is an integer of 1 to 4 $(CH_2CHR_6\text{—}O)_xH$ or salts thereof where $R_6$ is chosen from hydrogen or linear of branched $(C_1\text{-}C_4)$alkyl and x is an integer from 1 to 20; carboxy$(C_1\text{-}C_4)$alkyl or salts thereof, or $(CH_2CHR_6\text{—}O)_p(CH_2CHR_9\text{—}O)_xH$ or salts thereof where $R_9$ is hydrogen or linear or branched $(C_1\text{-}C_4)$alkyl and p is 1-20; $R_2$ is chosen from hydrogen; linear or branched $(C_1\text{-}C_4)$alkyl; $(CH_2CHR_6\text{—}O)_yH$ or salts thereof where $R_6$ is defined as above and y is an integer of 1 to 20; carboxy $(C_1\text{-}C_4)$alkyl or salts thereof; or $(CH_2CHR_6\text{—}O)_q(CH_2CHR_{10}\text{—}O)_yH$ or salts thereof where $R_{10}$ is hydrogen; linear or branched $(C_1\text{-}C_4)$alkyl and q is an integer of 1 to 20; $R_3$ is chosen from cocoalkyl; R'—O—$(CH_2)_m$ where R' is chosen from hydrogen, linear or branched, saturated or unsaturated $(C_1\text{-}C_{20})$alkyl, m is an integer of 1 to 4; $(CH_2)_mNR_7R_8$ where $R_7$ is $(CH_2CHR_6\text{—}O)_p(CH_2CHR_9\text{—}O)_xH$ or salts thereof and $R_8$ is $(CH_2CHR_6\text{—}O)_q(CH_2CHR_{10}\text{—}O)_yH$ or salts thereof; and G is $(CH_2CHR_6\text{—}O)_zH$ or salts thereof where z is an integer from 1 to 20 or →O and n is 0 or 1.

Methods include providing a substrate including a metal layer; contacting the substrate with an indium electroplating composition including one or more sources of indium ions, citric acid, salts thereof or mixtures thereof and one or more amine compounds in amounts of 0.1 ppm to 100 ppm having a formula:

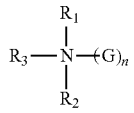

(I)

where $R_1$ is chosen from hydrogen; $(CH_2)_aNR_4R_5$ where $R_4$ and $R_5$ are independently chosen from hydrogen and linear or branched $(C_1\text{-}C_4)$alkyl and a is an integer of 1 to 4, $(CH_2CHR_6\text{—}O)_xH$ or salts thereof where $R_6$ is chosen from hydrogen or linear of branched $(C_1\text{-}C_4)$alkyl and x is an integer from 1 to 20; carboxy$(C_1\text{-}C_4)$alkyl or salts thereof; or $(CH_2CHR_6\text{—}O)_p(CH_2CHR_9\text{—}O)_xH$ or salts thereof wherein $R_9$ is hydrogen or linear or branched $(C_1\text{-}C_4)$alkyl and p is an integer of 1 to 20; $R_2$ is chosen from hydrogen; linear or branched $(C_1\text{-}C_4)$alkyl; $(CH_2CHR_6\text{—}O)_yH$ or salts thereof where $R_6$ is defined as above and y is an integer of 1 to 20; carboxy$(C_1\text{-}C_4)$alkyl or salts thereof; or $(CH_2CHR_6\text{—}O)_q(CH_2CHR_{10}\text{—}O)_yH$ or salts thereof where $R_{10}$ is hydrogen or linear or branched $(C_1\text{-}C_4)$alkyl and q is an integer of 1 to 20; $R_3$ is chosen from cocoalkyl; R'—O—$(CH_2)_m$ where R' is chosen from hydrogen, linear or branched, saturated or unsaturated $(C_1\text{-}C_{20})$alkyl, m is an integer of 1 to 4; $(CH_2)_mNR_7R_8$ where $R_7$ is $(CH_2CHR_6\text{—}O)_p(CH_2CHR_9\text{—}O)_xH$ or salts thereof and $R_8$ is $(CH_2CHR_6\text{—}O)_q(CH_2CHR_{10}\text{—}O)_yH$ or salts thereof; and G is $(CH_2CHR_6\text{—}O)_zH$ or salts thereof where z is an integer from 1 to 20 or →O and n is 0 or 1; and electroplating an indium metal layer on the metal layer of the substrate with the indium electroplating composition.

The indium electroplating compositions can provide indium metal on a metal layer which is substantially void-free, uniform and has smooth morphology. The ability to reproducibly plate a void-free uniform indium of target thickness, and smooth surface morphology enables the expanded use of indium in the electronics industry, including in semiconductors and polycrystalline thin film solar cells. The indium deposited from the electroplating composition of the present invention can be used as a low temperature solder material which is desired for 3D stack assembly to reduce damage on assembled chips by the thermal stress induced during reflow processing. The indium can also be used as thermal interface materials to protect electronic devices such as microprocessors and integrated circuits. The present invention addresses a number of problems of the prior inability to electroplate indium of sufficient properties to meet requirements for applications in advanced electronic devices.

DETAILED DESCRIPTION OF THE INVENTIONS

Figure 1A:
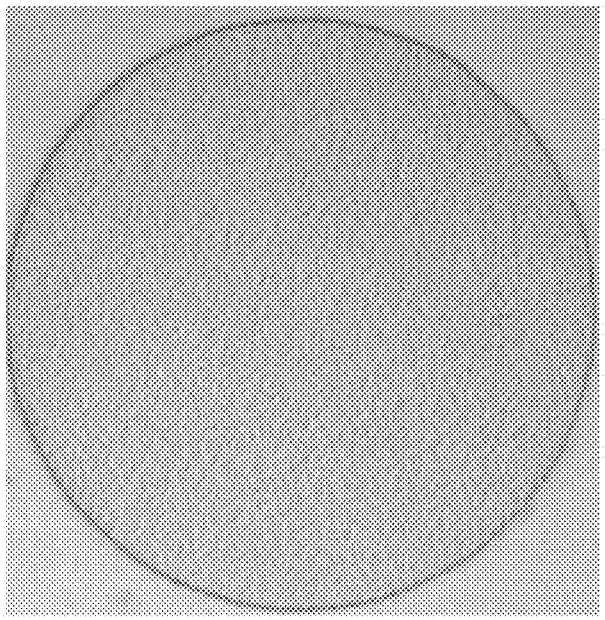
FIG. 1A is an optical microscope image of a nickel plated via having a diameter of 75 μm.

As used throughout the specification, the following abbreviations have the following meanings, unless the context clearly indicates otherwise: ° C.=degrees Centigrade; ° K=degrees Kelvin; g=gram; mg=milligram; L=liter; A=amperes; dm=decimeter; ASD=A/dm$^2$=current density; μm=micron=micrometer, ppm=parts per million; ppb=parts per billion; ppm=mg/L; indium ion=$In^{3+}$; $Li_+$=lithium ion; $Na^+$=sodium ion; $K^+$=potassium ion; $NH_4^+$=ammonium ion; nm=nanometers=$10^{-9}$ meters; μm=micrometers=$10^{-6}$ meters; M=molar; MEMS=micro-electro-mechanical systems; TIM=thermal interface material; IC=integrated circuits; EO=ethylene oxide and PO=propylene oxide.

The terms "depositing", "plating" and "electroplating" are used interchangeably throughout this specification. The term "copolymer" is a compound composed of two or more different mers. The term "cocoalkyl" means mainly even numbered $(C_{12}\text{-}C_{18})$alkyl. The term "tallow" means a mixture of a variety of fatty acids such as oleic, palmitic, stearic, myrisitic and linoleic acids. The term "dendrite" means branching spike-like metal crystals. Unless otherwise noted all plating baths are aqueous solvent based, i.e. water based, plating baths. All amounts are percent by weight and all ratios are by moles, unless otherwise noted. All numerical ranges are inclusive and combinable in any order except where it is logical that such numerical ranges are constrained to add up to 100%.

The compositions include one or more sources of indium ions which are soluble in an aqueous environment. The indium compositions are free of alloying metals. Such sources include, but are not limited to, indium salts of alkane sulfonic acids and aromatic sulfonic acids, such as methanesulfonic acid, ethanesulfonic acid, butane sulfonic acid, benzenesulfonic acid and toluenesulfonic acid, indium salts of sulfamic acid, sulfate salts of indium, chloride and bromide salts of indium, nitrate salts, hydroxide salts, indium oxides, fluoroborate salts, indium salts of carboxylic acids, such as citric acid, acetoacetic acid, glyoxylic acid, pyruvic acid, glycolic acid, malonic acid, hydroxamic acid, iminodiacetic acid, salicylic acid, glyceric acid, succinic acid, malic acid, tartaric acid, hydroxybutyric acid, indium salts of amino acids, such as arginine, aspartic acid, asparagine, glutamic acid, glycine, glutamine, leucine, lysine, threonine, isoleucine, and valine. Typically, the source of indium ions is one or more indium salts of sulfuric acid, sulfamic acid, alkane sulfonic acids, aromatic sulfonic acids and carboxylic acids. More typically, the source of indium ions is one or more indium salts of sulfuric acid and sulfamic acid.

The water-soluble salts of indium are included in the compositions in sufficient amounts to provide an indium deposit of the desired thickness. Preferably the water-soluble indium salts are included in the compositions to provide indium ($3^+$) ions in the compositions in amounts of 2 g/L to 70 g/L, more preferably from 2 g/L to 60 g/L, most preferably from 2 g/L to 30 g/L.

The compositions include one or more amine compounds in trace amounts of 0.1 ppm to 100 ppm, preferably in amounts of 5 ppm to 15 ppm and having a formula:

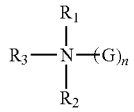

(I)

where $R_1$ is chosen from hydrogen; $(CH_2)_aNR_4R_5$ where $R_4$ and $R_5$ are independently chosen from hydrogen and linear or branched $(C_1\text{-}C_4)$alkyl and a is an integer of 1 to 4; $(CH_2CHR_6\text{—}O)_xH$ or salts thereof where $R_6$ is chosen from hydrogen or linear or branched $(C_1\text{-}C_4)$alkyl and x is an integer from 1 to 20; carboxy$(C_1\text{-}C_4)$alkyl or salts thereof; or $(CH_2CHR_6\text{—}O)_p(CH_2CHR_9\text{—}O)_xH$ or salts thereof wherein $R_9$ is hydrogen or linear or branched $(C_1\text{-}C_4)$alkyl and p is an integer of 1 to 20; $R_2$ is chosen from hydrogen; linear or branched $(C_1\text{-}C_4)$alkyl; $(CH_2CHR_6\text{—}O)_yH$ or salts thereof where $R_6$ is defined as above and y is an integer of 1 to 20; carboxy($C_1$-$C_4$)alkyl or salts thereof; $(CH_2CHR_6—O)_q(CH_2CHR_{10}—O)_yH$ or salts thereof where $R_{10}$ is hydrogen or linear or branched ($C_1$-$C_4$)alkyl and q is an integer of 1 to 20; $R_3$ is chosen from cocoalkyl; R'—O—$(CH_2)_m$ where R' is chosen from hydrogen, linear or branched, saturated or unsaturated ($C_1$-$C_{20}$)alkyl, m is an integer of 1 to 4; $(CH_2)_m NR_7R_8$ where $R_7$ is $(CH_2CHR_6—O)_p(CH_2CHR_9—O)_xH$ or salts thereof is and $R_8$ is $(CH_2CHR_6—O)_q(CH_2CHR_{10}—O)_yH$ or salts thereof; and G is $(CH_2CHR_6—O)_zH$ or salts thereof where z is an integer from 1 to 20 or →O and n is 0 or 1.

Preferably $R_1$ is chosen from hydrogen; $(CH_2)_aNR_4R_5$ where $R_4$ and $R_5$ are independently chosen from hydrogen and ($C_1$-$C_2$)alkyl, a is an integer of 2 to 3; $(CH_2CHR_6—O)_xH$ or salts thereof where $R_6$ is hydrogen or ($C_1$-$C_2$)alkyl and x is an integer of 1 to 12; carboxy($C_1$-$C_2$)alkyl or salts thereof; or $(CH_2CHR_6—O)_p(CH_2CHR_9—O)_xH$ or salts thereof where $R_9$ is hydrogen or ($C_1$-$C_2$)alkyl; more preferably $R_1$ is $(CH_2)_aNR_4R_5$ where $R_4$ and $R_5$ are independently chosen from hydrogen and methyl and a is an integer of 2 to 3; or $(CH_2CHR_6—O)_xH$ or salts thereof where $R_6$ is hydrogen and x is an integer of 1 to 10; preferably $R_2$ is chosen from hydrogen; ($C_1$-$C_2$)alkyl; $(CH_2CHR_6—O)_yH$ or salts thereof where $R_6$ is hydrogen or ($C_1$-$C_2$)alkyl and y is an integer of 1 to 12; carboxy($C_1$-$C_2$)alkyl or salts thereof; or $(CH_2CHR_6—O)_q(CH_2CHR_{10}—O)_yH$ or salts thereof where $R_{10}$ is hydrogen or ($C_1$-$C_2$)alkyl; more preferably $R_2$ is chosen from hydrogen; methyl; $(CH_2CHR_6—O)_yH$ or salts thereof where $R_6$ is hydrogen and y is an integer of 1 to 10; preferably $R_3$ is cocoalkyl; R'—O—$(CH_2)_m$ where R' is linear or branched, saturated or unsaturated ($C_2$-$C_{18}$)alkyl, m is an integer of 2 to 3; or $(CH_2)_mNR_7R_8$ where $R_7$ is $(CH_2CHR_6—O)_p(CH_2CHR_9—O)_xH$ or salts thereof and $R_8$ is $(CH_2CHR_6—O)_q(CH_2CHR_{10}—O)_yH$ or salts thereof where $R_9$ and $R_{10}$ are independently chosen from hydrogen and ($C_1$-$C_2$)alkyl, p and q are independently chosen from integers of 1 to 20 and, $R_6$ is hydrogen or methyl, m is an integer of 2 to 3 and x and y are independently chosen from integers of 1 to 20; more preferably $R_3$ is cocoalkyl; R'—O—$(CH_2)_m$ where R' is linear or branched, saturated or unsaturated ($C_2$-$C_{18}$)alkyl and m is an integer of 2 to 3; preferably n is 0 or 1 and when n is 1, G is $(CH_2CHR_6—O)_zH$ or salts thereof and z is an integer from 1 to 12; more preferably n is 0 or 1 and when n=1, G is $(CH_2CHR_6—O)_zH$ or salts thereof and z is an integer from 1 to 10.

Salts of the foregoing amine compounds include, but are not limited to alkali metal salts such as sodium, potassium and lithium salts, ammonium salts including inorganic and organic ammonium salts. Inorganic ammonium salts include, but are not limited to ammonium chloride, ammonium carbonate and ammonium nitrate. Organic ammonium salts include, but are not limited to alkyl ammonium chloride, alkyl ammonium carbonate and alkyl ammonium nitrate. Examples of such organic alkyl ammonium salts are methyl ammonium chloride and dimethyl ammonium chloride.

Such amine compounds disclosed above include ether amines, ether diamines, alkoxylated amines, quaternary amines and amine oxides.

Examples of a preferred ether amine have the following formula:

$$R'—O—CH_2CH_2CH_2NH_2 \quad (II)$$

where R' is linear or branched ($C_6$-$C_{14}$)alkyl. Such ether amines include hexyloxypropyl amine, 2-ethylhexylpropyl amine, octyloxypropyl amine, decyloxypropyl amine, isodecyloxypropyl amine, dodecyloxypropyl amine and tetradecyloxypropyl amine, isotridecyloxypropyl amine.

Examples of a preferred ether diamine have the following formula:

$$R'—O—(CH_2)_3NH(CH_2)_3NH_2 \quad (III)$$

where R' is linear or branched ($C_8$-$C_{14}$)alkyl. Such ether diamines include octyloxypropyl-1,3-diaminopropane, decyloxypropyl-1,3-diaminopropane, isodecyloxypropyl-1,3-diaminopropane, dodecyloxypropyl-1,3-diaminopropane, tetradecyloxypropyl-1,3-diaminopropane and isotridecyloxypropyl-1,3-diaminopropane.

Another example of a preferred ether diamine is the compound having the following formula:

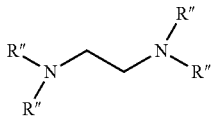

(IV)

where R" $(EO)_u(PO)v$ where u and v are integers of 1 to 20. Such compounds include ethylenediamine tetrakis(ethoxylate-block-propoxylate) tetrol.

Examples of a preferred ethoxylated amine have the following formula:

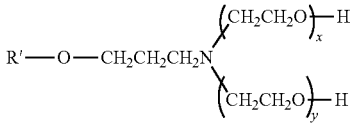

(V)

where R' is linear or branched, saturated or unsaturated ($C_{10}$-$C_{18}$)alkyl and x and y are defined as above. Such compounds include bis-(2-hydroxyethyl) isodecyoxypropylamine, poly (5) oxyethylene isotridecyloxypropylamine, bis-(2-hydroxyethyl) isotridecyloxypropylamine, poly (5) oxyethylene isodecyloxypropylamine and bis-(2-hydroxyethyl) tallow amine.

Examples of a preferred quaternary amine have the following formula:

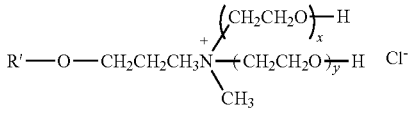

(VI)

where R' is linear or branched ($C_{10}$-$C_{18}$)alkyl and x and y are defined as above and a source of chloride ions is methyl ammonium chloride. Such quaternary amines include isodecyloxypropyl bis-(2-hydroxyethyl) methyl ammonium chloride, isotridecyloxypropyl bis-(2-hydoxyethyle) methyl ammonium chloride and coco poly (15) oxyethylene methyl ammonium chloride.

Examples of a preferred amine oxide have the following formula:

(VII)

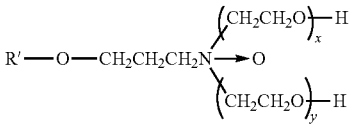

where R' is linear or branched ($C_{10}$-$C_{18}$)alky and x and y are defined as above. Such amine oxides include bis-(2-hydroxyethyl)isotridecyloxypropylamine oxide.

Citric acid, salts thereof or mixtures thereof is included in the indium compositions. Citric acid salts include, but are not limited to sodium citrate dehydrate, monosodium citrate, potassium citrate and diammonium citrate. Citric acid, salts thereof or mixtures thereof can be included in amounts of 5 g/L to 300 g/L, preferably from 50 g/L to 200 g/L. Preferably a mixture of citric acid and its salts are included in the indium compositions in the foregoing amounts.

Optionally, but preferably, one or more sources of chloride ions are included in the indium electroplating compositions. Sources of chloride ions include, but are not limited to sodium chloride, potassium chloride, hydrogen chloride or mixtures thereof. Preferably the source of chloride ions is sodium chloride, potassium chloride or mixtures thereof. More preferably the source of chloride ions is sodium chloride. One or more sources of chloride ions are included in the indium compositions such that a molar ratio of chloride ions to indium ions is at least 2:1, preferably from 2:1 to 7:1, more preferably from 4:1 to 6:1.

Optionally, in addition to citric acid or its salts, one or more additional buffers can be included in the indium compositions to provide a pH of 1-4, preferably from 2-3. The buffer includes an acid and the salt of its conjugate base. Acids include amino acids, carboxylic acids, glyoxylic acid, pyruvic acid, hydroxamic acid, iminodiacetic acid, salicylic acid, succinic acid, hydroxybutyric acid, acetic acid, acetoacetic acid, tartaric acid, phosphoric acid, oxalic acid, carbonic acid, ascorbic acid, boric acid, butanoic acid, thioacetic acid, glycolic acid, malic acid, formic acid, heptanoic acid, hexanoic acid, hydrofluoric acid, lactic acid, nitrous acid, octanoic acid, pentanoic acid, uric acid, nonanoic acid, decanoic acid, sulfurous acid, sulfuric acid, alkane sulfonic acids and aryl sulfonic acids such as methanesulfonic acid, ethanesulfonic acid, benzenesulfonic acid, toluenesulfonic acid, sulfamic acid. The acids are combined with $Li^+$, $Na^+$, $K^+$, $NH_4^+$ or $(C_nH_{(2n+1)})_4N^+$ salts of conjugate bases where n is an integer from 1 to 6.

Optionally, the indium compositions can include one or more grain refiners. Such grain refiners include, but are not limited to 2-picolinic acid, Sodium 2-napthol-7-sulfonate, 3-(benzothiazol-2-ylthio)propane-1-sulfonic acid (ZPS), 3-(carbamimidoylthio)propane-1-sulfonic acid (UPS), bis (sulfopropyl)disulfide (SPS), mercaptopropane sulfonic acid (MPS), 3-N,N-dimethylaminodithiocarbamoyl-1-propane sulfonic acid (DPS), and (O-ethyldithiocarbonato)-S-(3-sulfopropyl)-ester (OPX). Preferably such grain refiners are included in the indium compositions in amounts of 0.1 ppm to 5 g/L, more preferably from 0.5 ppm to 1 g/L.

Optionally, one or more suppressors can be included in the indium compositions. Suppressors include, but are not limited to 1,10-phenanthroline and derivatives thereof, triethanolamine and its derivatives, such as triethanolamine lauryl sulfate, sodium lauryl sulfate and ethoxylated ammonium lauryl sulfate, polyethyleneimine and its derivatives, such as hydroxypropylpolyeneimine (HPPEI-200), and alkoxylated polymers. Such suppressors are included in the indium compositions in conventional amounts. Typically, suppressors are included in amounts of 1 ppm to 5 g/L.

Optionally, one or more levelers can be included in the indium compositions. Levelers include, but are not limited to, polyalkylene glycol ethers. Such ethers include, but are not limited to, dimethyl polyethylene glycol ether, di-tertiary butyl polyethylene glycol ether, polyethylene/polypropylene dimethyl ether (mixed or block copolymers), and octyl monomethyl polyalkylene ether (mixed or block copolymer). Such levelers are included in conventional amounts. In general, such levelers are included in amounts of 100 ppb to 500 ppb.

Optionally, one or more hydrogen suppressors can included in the indium compositions to suppress hydrogen gas formation during indium metal electroplating. Hydrogen suppressors include epihalohydrin copolymers. Epihalohydrins include epichlorohydrin and epibromohydrin. Typically, copolymers of epichlorohydrin are used. Such copolymers are water-soluble polymerization products of epichlorohydrin or epibromohydrin and one or more organic compounds which includes nitrogen, sulfur, oxygen atoms or combinations thereof.

Nitrogen-containing organic compounds copolymerizable with epihalohydrins include, but are not limited to:

1) aliphatic chain amines;
2) unsubstituted heterocyclic nitrogen compounds having at least two reactive nitrogen sites; and,
3) substituted heterocyclic nitrogen compounds having at least two reactive nitrogen sites and having 1-2 substitution groups chosen from alkyl groups, aryl groups, nitro groups, halogens and amino groups.

Aliphatic chain amines include, but are not limited to, dimethylamine, ethylamine, methylamine, diethylamine, triethyl amine, ethylene diamine, diethylenetriamine, propylamine, butylamine, pentylamine, hexylamine, heptylamine, octylamine, 2-ethylhexylamine, isooctylamine, nonylamine, isononylamine, decylamine, undecylamine, dodecylaminetridecylamine and alkanol amines.

Unsubstituted heterocyclic nitrogen compounds having at least two reactive nitrogen sites include, but are not limited to, imidazole, imidazoline, pyrazole, 1,2,3-triazole, tetrazole, pyradazine, 1,2,4-triazole, 1,2,3-oxadiazole, 1,2,4-thiadiazole and 1,3,4-thiadiazole.

Substituted heterocyclic nitrogen compounds having at least two reactive nitrogen sites and having 1-2 substitutions groups include, but are not limited to, benzimidazole, 1-methylimidazole, 2-methylimidazole, 1,3-diemthylimidazole, 4-hydroxy-2-amino imidazole, 5-ethyl-4-hydroxyimidazole, 2-phenylimidazoline and 2-tolylimidazoline.

Preferably, one or more compounds chosen from imidazole, pyrazole, imidazoline, 1,2,3-triazole, tetrazole, pyridazine, 1,2,4-triazole, 1,2,3-oxadiazole, 1,2,4-thiadiazole and 1,3,4-thiadiazole and derivatives thereof which incorporate 1 or 2 substituents chosen from methyl, ethyl, phenyl and amino groups are used to form the epihalohydrin copolymer.

Some of the epihalohydrin copolymers are commercially available such as from Raschig GmbH, Ludwigshafen Germany and from BASF, Wyandotte, Mich., USA, or may be made by methods disclosed in the literature. An example of a commercially available imidazole/epichlorohydrin copolymer is LUGALVAN® IZE copolymer, obtainable from BASF.

Epihalohydrin copolymers can be formed by reacting epihalohydrins with the nitrogen, sulfur or oxygen containing compounds described above under any suitable reaction conditions. For example, in one method, both materials are dissolved in suitable concentrations in a body of mutual solvent and reacted therein at, for example, 45 to 240 minutes. The aqueous solution chemical product of the reaction is isolated by distilling off the solvent and then is added to the body of water which serves as the electroplating solution, once the indium salt is dissolved. In another method these two materials are placed in water and heated to 60° C. with constant vigorous stirring until they dissolve in the water as they react.

A wide range of ratios of the reaction compound to epihalohydrin can be used, such as from 0.5:1 to 2:1 moles. Typically the molar ratio is from 0.6:1 to 2:1 moles, more typically the molar ratio is 0.7 to 1:1, most typically the molar ratio is 1:1.

Additionally, the reaction product may be further reacted with one or more reagents before the electroplating composition is completed by the addition of indium salt. Thus, the described product may be further reacted with a reagent which is at least one of ammonia, aliphatic amine, polyamine and polyimine. Typically, the reagent is at least one of ammonia, ethylenediamine, tetraethylene pentamine and a polyethyleneimine having a molecular weight of at least 150, although other species meeting the definitions set forth herein may be used. The reaction can take place in water with stirring.

For example, the reaction between the reaction product of epichlorohydrin and a nitrogen-containing organic compound as described above and a reagent chosen from one or more of ammonia, aliphatic amine, and arylamine or polyimine can take place and can be carried out at a temperature of, for example, 30° C. to 60° C. for, example, 45 to 240 minutes. The molar ratio between the reaction product of the nitrogen containing compound-epichlorohydrin reaction and the reagent is typically 1:0.3-1.

The epihalohydrin copolymers are included in the compositions in amounts of 0.01 g/L to 100 g/L. preferably, epihalohydrin copolymers are included in amounts of 0.1 g/L to 80 g/L, more preferably, they are included in amounts of 0.1 g/L to 50 g/L, most preferably in amounts of 1 g/L to 30 g/L.

The indium compositions may be used to deposit substantially uniform, void-free, indium metal layers on metal layers of various substrates. The indium layers are also substantially dendrite-free. The thin film indium layers preferably range in thickness from 10 nm to 100 μm, more preferably from 100 nm to 75 μm.

Apparatus used to deposit indium metal on metal layers is conventional. Preferably conventional soluble indium electrodes are used as the anode. Any suitable reference electrode may be used. Typically, the reference electrode is a silver chloride/silver electrode. Current densities may range from 0.1 ASD to 10 ASD, preferably from 0.1 to 5 ASD, more preferably from 1 to 4 ASD.

The temperatures of the indium compositions during indium metal electroplating can range from room temperature to 80° C. Preferably, the temperatures range from room temperature to 65° C., more preferably from room temperature to 60° C. Most preferably the temperature is room temperature.

The indium compositions may be used to electroplate indium metal on nickel, copper, gold and tin layers of various substrates, including components for electronic devices, for magnetic field devices and superconductivity MRIs. Preferably indium is electroplated on nickel. The metal layers preferably range from 10 nm to 100 μm, more preferably from 100 nm to 75 μm. The indium compositions may also be used with conventional photoimaging methods to electroplate indium metal small diameter solder bumps on various substrates such as silicon wafers. Small diameter bumps preferably have diameters of 1 μm to 100 μm, more preferably from 2 μm to 50 μm, with aspect ratios of 1 to 3.

For example, the indium compositions may be used to electroplate indium metal on a component for an electrical device to function as a TIM, such as for, but not limited to, ICs, microprocessors of semiconductor devices, MEMS and components for optoelectronic devices. Such electronic components may be included in printed wiring boards and hermetically sealed chip-scale and wafer-level packages. Such packages typically include an enclosed volume which is hermetically sealed, formed between a base substrate and lid, with the electronic device being disposed in the enclosed volume. The packages provide for containment and protection of the enclosed device from contamination and water vapor in the atmosphere outside the package. The presence of contamination and water vapor in the package can give rise to problems such as corrosion of metal parts as well as optical losses in the case of optoelectronic devices and other optical components. The low melting temperature (156° C.) and high thermal conductivity (~82 W/m° K) are properties which make indium metal highly desirable for use as a TIM.

In addition to TIMs, the indium compositions may be used to electroplate underlayers on substrates to prevent whisker formation in electronic devices. The substrates include, but are not limited to, electrical or electronic components or parts such as film carriers for mounting semiconductor chips, printed circuit boards, lead frames, contacting elements such as contacts or terminals and plated structural members which demand good appearance and high operation reliability.

The following examples further illustrate the invention, but are not intended to limit the scope of the invention.

Example 1 (Comparative)

Photoresist patterned silicon wafers from Silicon Valley Microelectronics, Inc. with a plurality of vias having a diameter of 75 m and copper seed layer at the base of each via were electroplated with a nickel layer using NIKAL™ BP nickel electroplating bath available from Dow Advanced Materials. Nickel electroplating was done at 55° C., with a cathode current density of 1 ASD for 120 seconds. A conventional rectifier supplied the current. The anode was a soluble nickel electrode. After plating the silicon wafer was removed from the plating bath, the photoresist was stripped from the wafers with SHIPLEY BPR™ Photostripper available from Dow Advanced Materials and rinsed with water. The nickel deposits appeared substantially smooth and without any observable dendrites on the surface. FIG. 1A is an optical image of one of the nickel plated copper seed layers taken with a LEICA™ optical microscope.

The following aqueous indium electrolytic composition was prepared:

TABLE 1

| COMPONENT | AMOUNT |
|---|---|
| Indium sulfate | 45 g/L |
| Citric acid | 96 g/L |
| Sodium citrate dihydrate | 59 g/L |

The foregoing nickel layer electroplating process was repeated on another set of photoresist patterned wafers except that after electroplating the nickel layer, the nickel plated silicon wafers were immersed in the indium electroplating composition and indium metal was electroplated on the nickel. Indium electroplating was done at 25° C. at a current density of 4ASD for 30 seconds. The pH of the indium electroplating composition was 2.4. The anode was an indium soluble electrode. After the indium was plated on the nickel, the photoresist was stripped from the wafers and the morphology of the indium deposits was observed. All of the indium deposits appeared rough.

Figure 1B:
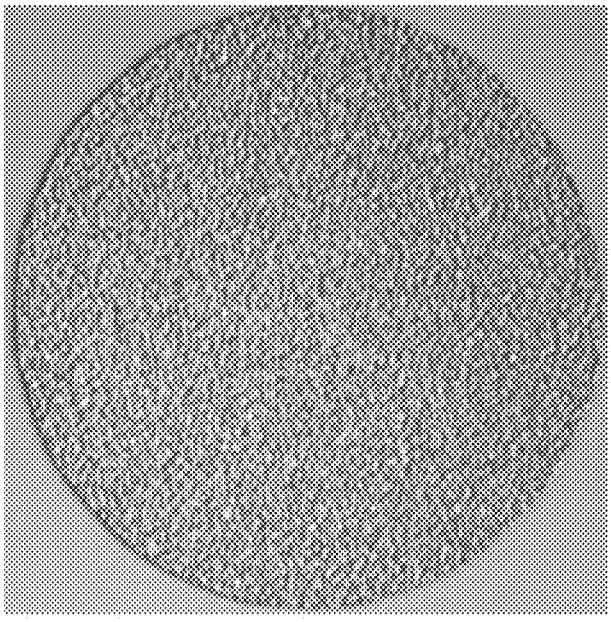
FIG. 1B is an optical microscope image of an indium layer on a nickel plated via having a diameter of 75 μm.

FIG. 1B is an optical image of one of the indium metal deposits electroplated on the nickel layer. The indium deposit was very rough in contrast to the nickel deposit as shown in FIG. 1A.

Example 2

Photoresist patterned silicon wafers from Silicon Valley Microelectronics, Inc. with a plurality of rectangular vias having lengths of 50 μm and copper seed layer at the base of each via were electroplated with a nickel layer using NIKAL™ BP nickel electroplating bath available from Dow Advanced Materials. Nickel electroplating was done at 55° C., with a cathode current density of 1 ASD for 120 seconds. A conventional rectifier supplied the current. The anode was a soluble nickel electrode. After plating the silicon wafer was removed from the plating bath, the photoresist was stripped from the wafers with SHIPLEY BPR™ Photostripper available from Dow Advanced Materials and rinsed with water. The nickel deposits appeared substantially smooth and without any observable voids on the surface.

The following aqueous indium electrolytic composition was prepared:

TABLE 2

| COMPONENT | AMOUNT |
|---|---|
| Indium sulfate | 45 g/L |
| Citric acid | 96 g/L |
| Sodium citrate dihydrate | 59 g/L |
| Sodium chloride[1] | 50 g/L |
| Coco poly (15) oxyethylene methyl ammonium chloride[2] | 10 ppm |

[1]Molar ratio of chloride:indium ions = 5:1
[2]TOMAMINE Q-C-15 quaternary amine surfactant available from Air Products The nickel plated silicon wafers were immersed in the indium electroplating composition and indium metal was electroplated on the nickel. Indium electroplating was done at 25° C. at a current density of 4ASD for 30 seconds. The pH of the plating composition was 2.4. After indium was electroplated on the nickel, the photoresist was stripped from the wafers and the indium morphology was observed. All of the indium deposits appeared uniform and smooth.

Example 3

An indium electroplating composition having the following components was prepared:

TABLE 3

| COMPONENT | AMOUNT |
|---|---|
| Indium sulfate | 45 g/L |
| Citric acid | 96 g/L |
| Sodium citrate dihydrate | 59 g/L |
| Sodium chloride | 50 g/L |

TABLE 3-continued

| COMPONENT | AMOUNT |
|---|---|
| Dodecyl/tetradecyloxypropyl amine mixture[3] | 10 ppm |

[3]TOMAMINE ® PA-1618 ether amine surfactant available from Air Products

A nickel plated silicon wafer as described in Example 2 above was immersed in the indium electroplating composition. Indium electroplating was done at 25° C. at a current density of 4 ASD for 11 seconds. The pH of the indium composition during electroplating was 2.4. The anode was an indium soluble electrode. The indium deposits appeared smooth in contrast to the indium deposit of FIG. 1B.

Example 4

An indium electroplating composition which included the following components was prepared:

TABLE 4

| COMPONENT | AMOUNT |
|---|---|
| Indium sulfate | 45 g/L |
| Citric acid | 96 g/L |
| Sodium citrate dihydrate | 59 g/L |
| Sodium chloride | 50 g/L |
| Ethylenediamine tetrakis(ethoxylate-block-propoxylate) tetrol[4] | 100 ppm |

[4]TETRONIC ™ 90R4 surfactant available from BASF

A nickel plated silicon wafer as described in Example 2 above was immersed in the indium electroplating composition. Indium electroplating was done at 25° C. at a current density of 4 ASD for 11 seconds. The pH of the indium composition during electroplating was 2.4. The anode was an indium soluble electrode. The indium deposits appeared smooth in contrast to the indium deposit of FIG. 1B.

Example 5

An indium electroplating composition having the following components was prepared:

TABLE 5

| COMPONENT | AMOUNT |
|---|---|
| Indium sulfate | 45 g/L |
| Citric acid | 96 g/L |
| Sodium citrate dihydrate | 59 g/L |
| Sodium chloride | 50 g/L |
| Dodecyl/tetradecyloxypropyl amine mixture[5] | 10 ppm |

[5]TOMAMINE ® PA-1816 ether amine surfactant available from Air Products

A nickel plated silicon wafer as described in Example 2 above was immersed in the indium electroplating composition. Indium electroplating was done at 25° C. at a current density of 4 ASD for 11 seconds. The pH of the indium composition during electroplating was 2.4. The anode was an indium soluble electrode. The indium deposits appeared smooth in contrast to the indium deposit of FIG. 1B.

Example 6

Photoresist patterned silicon wafers from IMAT with a plurality of vias having dimensions of 50 μm (diameter)×50 μm (depth) and copper seed layer at the base of each via were electroplated with a nickel layer using NIKAL™ BP nickel electroplating bath available from Dow Advanced Materials. Nickel electroplating was done at 55° C., with a cathode current density of 1 ASD for 120 seconds. A conventional rectifier supplied the current. The anode was a soluble nickel electrode. After plating the silicon wafer was removed from the plating bath, and rinsed with water. The nickel deposits appeared substantially smooth and without any observable dendrites on the surface.

The following aqueous indium electrolytic composition was prepared:

TABLE 6

| COMPONENT | AMOUNT |
|---|---|
| Indium sulfate | 45 g/L |
| Citric acid | 96 g/L |
| Sodium citrate dihydrate | 59 g/L |
| Sodium chloride[6] | 50 g/L |
| Coco poly (15) oxyethylene methyl ammonium chloride[7] | 5 ppm |

[6]Molar ratio of chloride:indium ions = 5:1
[7]TOMAMINE Q-C-15 quaternary amine surfactant available from Air Products The nickel plated silicon wafers were immersed in the indium electroplating composition and indium metal was electroplated on the nickel. Indium electroplating was done at 25° C. at a current density of 4ASD for 30 seconds. The pH of the plating composition was 2.4. After indium was electroplated on the nickel, the photoresist was stripped from the wafers and the indium morphology was observed. All of the indium deposits appeared uniform and smooth.

Figure 2:
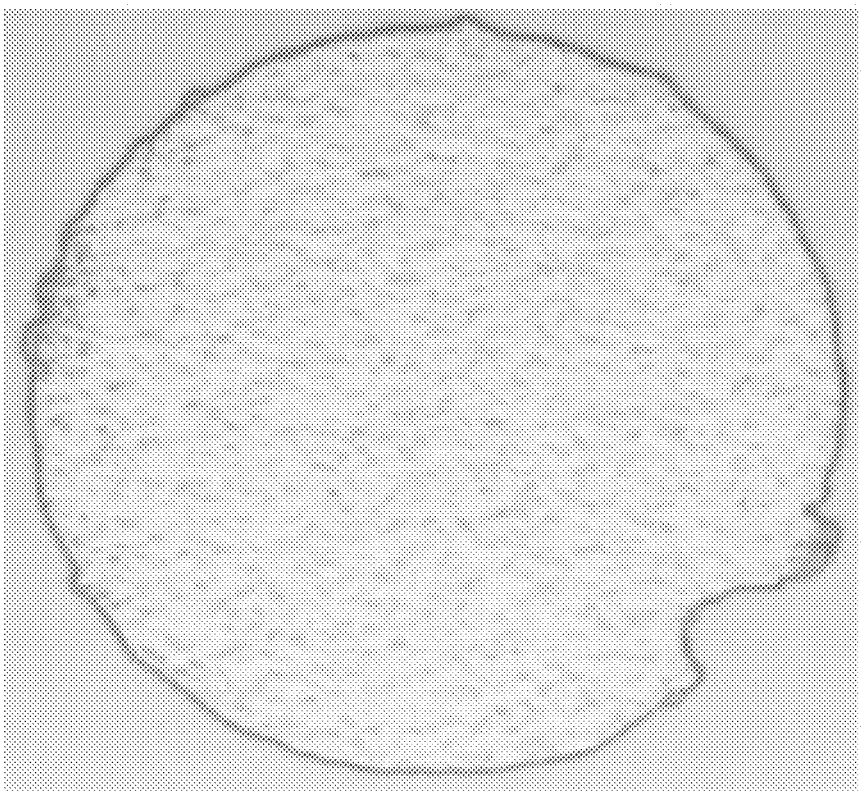
FIG. 2 is an optical microscope image of indium metal deposit electroplated on nickel.

FIG. 2 is an optical microscope image of one of the indium metal deposits electroplated on the nickel. The image was taken with a LEICA™ optical microscope. The indium deposit appeared very smooth.

Example 7 (Comparative)

The method of Example 6 was repeated except the indium composition had the formula disclosed in Table 7.

TABLE 7

| COMPONENT | AMOUNT |
|---|---|
| Indium sulfate | 45 g/L |
| Citric acid | 96 g/L |
| Sodium citrate dihydrate | 59 g/L |
| Sodium chloride[8] | 50 g/L |
| Coco poly (15) oxyethylene methyl ammonium chloride[9] | 20 ppm |

Figure 3:
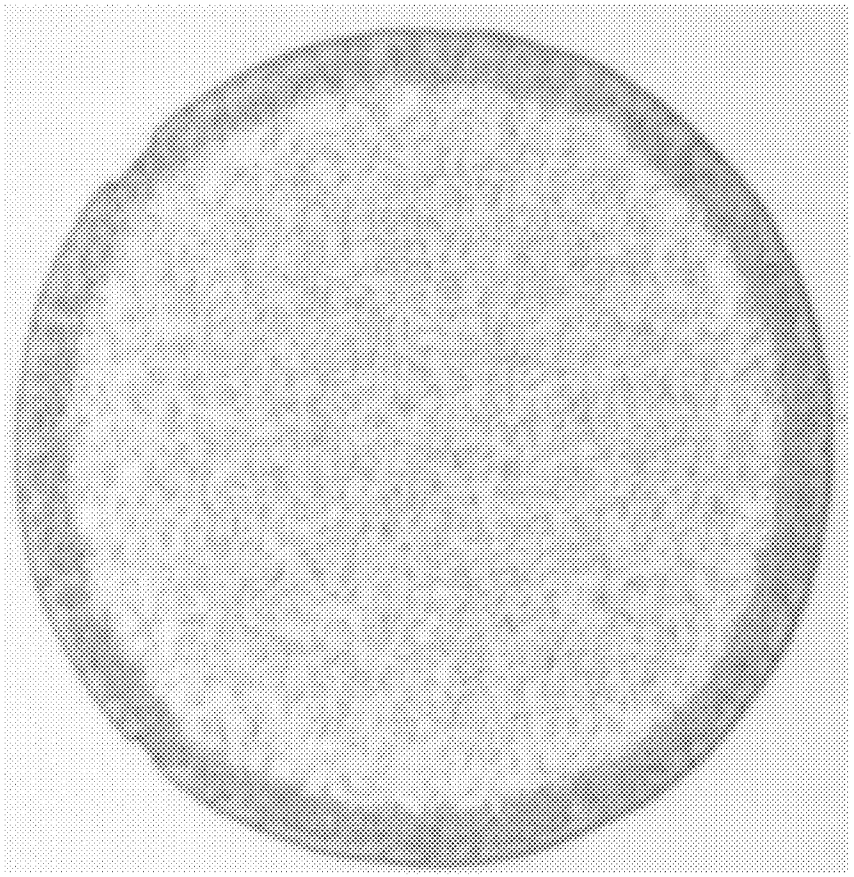
FIG. 3 is an optical microscope image of an indium metal deposit electroplated on nickel with poor indium deposition.

[8]Molar ratio of chloride:indium ions = 5:1
[9]TOMAMINE Q-C-15 quaternary amine surfactant available from Air Products After indium was electroplated on the nickel, the photoresist was stripped from the wafers and the indium morphology was observed. Indium plating was irregular and suppressive. The deposits were poor and indium plating was incomplete. FIG. 3 is an optical image of one of the vias plated with the indium composition of Table 7. As is apparent from FIG. 3 the indium plating was poor and suppressive.

What is claimed is:

1. A method comprising:

a) providing a substrate comprising a nickel layer;

b) contacting the substrate with an indium electroplating composition comprising one or more sources of indium ions, citric acid, salts thereof or mixtures thereof, and one or more amine compounds in amounts of 0.1 ppm to 100 ppm having a formula:

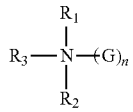

(I)

where $R_1$ is chosen from hydrogen; $(CH_2)_aNR_4R_5$ where $R_4$ and $R_5$ are independently chosen from hydrogen and linear or branched $(C_1\text{-}C_4)$alkyl and a is an integer of 1 to 4 $(CH_2CHR_6\text{—}O)_xH$ or salts thereof where $R_6$ is chosen from hydrogen or linear of branched $(C_1\text{-}C_4)$ alkyl and x is an integer from 1 to 20; carboxy$(C_1\text{-}C_4)$ alkyl or salts thereof; or $(CH_2CHR_6\text{—}O)_p(CH_2CHR_9\text{—}O)_xH$ or salts thereof where $R_9$ is hydrogen or linear or branched $(C_1\text{-}C_4)$alkyl; $R_2$ is chosen from hydrogen; linear or branched $(C_1\text{-}C_4)$ alkyl; $(CH_2CHR_6\text{—}O)_yH$ of salts thereof where $R_6$ is defined as above and y is an integer of 1 to 20; carboxy$(C_1\text{-}C_4)$alkyl or salts thereof; or $(CH_2CHR_6\text{—}O)_q(CH_2CHR_{10}\text{—}O)_yH$ or salts thereof where $R_{10}$ is hydrogen or linear or branched $(C_1\text{-}C_4)$alkyl; $R_3$ is chosen from cocoalkyl; R'—O—$(CH_2)_m$ where R' is chosen from linear or branched, saturated or unsaturated $(C_1\text{-}C_{20})$alkyl, m is an integer of 1 to 4; $(CH_2)_mNR_7R_8$ where $R_7$ is $(CH_2CHR_6\text{—}O)_p(CH_2CHR_9\text{—}O)_xH$ or salts thereof and $R_8$ is $(CH_2CHR_6\text{—}O)_q(CH_2CHR_{10}\text{—}O)_yH$ or salts thereof; p and q are integers from 1-20; and G is $(CH_2CHR_6\text{—}O)_zH$ or salts thereof where z is an integer from 1 to 20 and n is 0 or 1; and wherein the indium electroplating composition is free of alloying metals; and c) electroplating an indium metal layer on the nickel layer of the substrate with the indium electroplating composition.

2. The method of claim 1, wherein the one or more amine compounds are in amounts of 5 ppm to 15 ppm.

3. The method of claim 1, wherein the indium electroplating composition further comprises chloride ions.

4. The method of claim 3, wherein a molar ratio of chloride ions to indium ions is at least 2:1.

* * * * *